United States Patent [19]

Shelley

[11] 4,118,905

[45] Oct. 10, 1978

[54] MODULAR BUILDING CONSTRUCTION SYSTEM

[76] Inventor: Shelley W. Shelley, P.H. No. 1, Castillo Del-Mar Condominium Isla-Verde, Carolina, P.R. 00913

[21] Appl. No.: 817,869

[22] Filed: Jul. 21, 1977

[51] Int. Cl.[2] ..... E04H 1/12

[52] U.S. Cl. ..... 52/79.2; 52/236.4

[58] Field of Search ..... 52/79.2, 79.3, 79.4, 52/79.5, 79.6, 79.7, 236.4, 220

[56] References Cited

U.S. PATENT DOCUMENTS

| | | | |
|---|---|---|---|
| 3,256,651 | 6/1966 | Kallman | 52/73 |
| 3,455,074 | 7/1969 | Rice | 52/223 |
| 3,609,929 | 10/1971 | Brown et al. | 52/79.3 X |
| 3,716,954 | 2/1973 | Kelbish | 52/79.2 |
| 3,835,601 | 9/1974 | Kelbish | 52/79 |

*Primary Examiner*—Price C. Faw, Jr.
*Assistant Examiner*—Carl D. Friedman
*Attorney, Agent, or Firm*—Lee C. Robinson, Jr.

[57] ABSTRACT

A modular construction system for a plural-level building formed of a plurality of box-like modular units. Each unit includes side walls, a roof and a floor, and has a cantilevered portion. When stacked to form a building structure, the units are arranged in a first row in staggered configuration with alternate units in the first row extending in a frontward direction and the remaining units in the first row extending in a rearward direction, with the cantilevered portions of the frontwardly extending units overlapping with the cantilevered portions of the rearwardly extending units. The units are further stacked in a second row overlying the first row with the units in the second row being in staggered configuration wherein alternate units in the second row extend in a frontward direction and the remaining units extend in a rearward direction. A unit in the second row is supported by each of two alternate units in the first row which extend in a like direction as that of the one unit in the second row; and at least a part of the cantilevered portion of the one unit in the second row is supported at least in part by an adjacent unit.

18 Claims, 7 Drawing Figures

REAR 14
18
14'
A
40
A'
17
32
34
A
B*
12
16
12'
24'
20
24
A*
28
30
31
B
38
B'
B
26'
FRONT
22
26

MODULAR BUILDING CONSTRUCTION SYSTEM

BACKGROUND OF THE INVENTION

This invention relates to a construction system for a plural-level building, such as a multi-story residential building, a hotel or the like, and, more particularly, to a modular construction system wherein the building is erected from box-like modular units which are produced at a factory and which are erected at a building site. The modular units are designed to cooperate with each other so as to minimize duplication of walls, support columns and the like in such units.

Modular construction systems are known wherein each modular unit is pre-formed at a factory for final assembly at a building site, the modular units being stackable in various arrays to form a completed building. The interiors of such units also can be prepared at the factory, and various plumbing and electrical conduits, as well as heating and air circulating ducts, can be formed in the units and merely interconnected when such units are stacked to form the completed building.

In some previously proposed modular construction systems, each unit is provided with forward and rearward support columns, which columns essentially define the length and width of the unit. When stacking such units, the support columns must overlap with each other. In some constructions, these modular units can be arranged in a row of staggered configuration. But this arrangement heretofore has required at least one additional pair of support columns, typically provided intermediate the forward and rearward defining columns, to provide support for the staggered units. Furthermore, the staggered units in a row in such arrangements have their columns aligned along longitudinal axes in order to support the next row of overlying, staggered units. This additional pair of support columns for each unit adds to the cost of production and also to the overall weight of each modular unit, and tends to limit the flexibility of determining final constructional arrangements.

OBJECTS OF THE INVENTION

Therefore, it is an object of the present invention to provide an improved modular construction system.

Another object of this invention is to provide a modular construction system which avoids the necessity of duplicative support columns, one next to the other, for adjacently located units, thereby minimizing the cost of production and overall weight of each unit.

A further object of this invention is to provide a modular construction system using box-like modular units having forward and rearward support columns, and wherein the overall length of each unit is greater than the distance between the forward and rearward support columns.

An additional object of this invention is to provide a modular construction system formed of modular units, each unit having support columns and a cantilevered portion extending beyond such columns into the interior of the building, and wherein the size of the cantilevered portion, when constructed, may be reduced.

Yet another object of this invention is to provide an economical modular construction system formed of stackable box-like units wherein duplication of support columns in such units is avoided.

A still further object of this invention is to provide a modular construction system formed of box-like units having cantilevered portions and arranged so as to form utility shafts and other spaces between the walls of adjacent units and between the floor and ceiling of stacked units.

Various other objects, advantages and features of the present invention will become more readily apparent from the ensuing detailed description, and the novel features will be particularly pointed out in the appended claims.

SUMMARY OF THE INVENTION

In accordance with this invention, a modular construction system is provided for a plural-level building, such as a multistory residential building, hotel or the like. The construction system is formed of a plurality of box-like modular units, each unit including side walls, a roof or ceiling member, and a floor, and additionally having a cantilevered portion. In one embodiment, a plurality of support columns is formed with each unit, the columns including a pair of forward columns and a pair of rearward columns, such that the cantilevered portion extends beyond one of the pairs of columns. When stacked to form a building structure, the units are arranged in a first row in staggered configuration with alternate units in the first row extending in a frontward direction and the remaining units in that first row extending in a rearward direction. The cantilevered portions of the units extending in the frontward direction overlap with the cantilevered portions of the units which extend in the rearward direction. Further units are arranged in a second row overlying the first row, with the units in the second row being in staggered configuration such that the alternate units in that second row extend in a frontward direction and the remaining units in that second row extend in a rearward direction. A unit in the second row is supported by each of two alternate units in the first row, i.e., of the lower floor, which alternate units extend in a like direction as the one unit in the second row. At least a part of the cantilevered portion of the unit in the second row is supported by one or more adjacent units, which adjacent unit either is in the same or the next higher or lower row and extends in the opposite direction (e.g., it is disposed on the opposite side of the building). As used herein, the term "overlap" is intended to mean horizontal overlap; that is, an overlapping configuration of units in the same row when viewed in the horizontal direction.

In one embodiment, the ceiling of the cantilevered portion of the unit is lower than the ceiling of the remainder, or main portion, of the unit and the walls in that cantilevered portion are spaced closer to each other than the external width of the unit so that spaces or utility shafts are formed between such walls of adjacent and overlying units when the units are stacked. In some instances, part of the ceiling of the main portion of an adjacent unit will be lower than the remainder of that unit. Spaces or utility shafts also are formed between the ceiling of the cantilevered portion of one unit and the floor of an overlying unit.

In another embodiment, when the units are arranged to form a building, public corridors are formed in the respective cantilevered portions of staggered units. Hence, since side walls merely would extend normal to, and thus would obstruct the corridor, such side walls are not necessary, thereby reducing the overall cost of construction and weight of each unit.

When the units are stacked to form a building, the support, or load-bearing columns, will be in vertical alignment. These columns may be post-tensioned by rods or cables passing through the columns to form a unitary assembly. In such assembly, interior units at intermediate levels will be structurally interlinked with at least four other units of adjacent unit stacks.

BRIEF DESCRIPTION OF THE DRAWINGS

The following detailed description, given by way of example will best be understood in conjunction with the accompanying drawings in which.

DETAILED DESCRIPTION OF CERTAIN EMBODIMENTS

Figure 1:
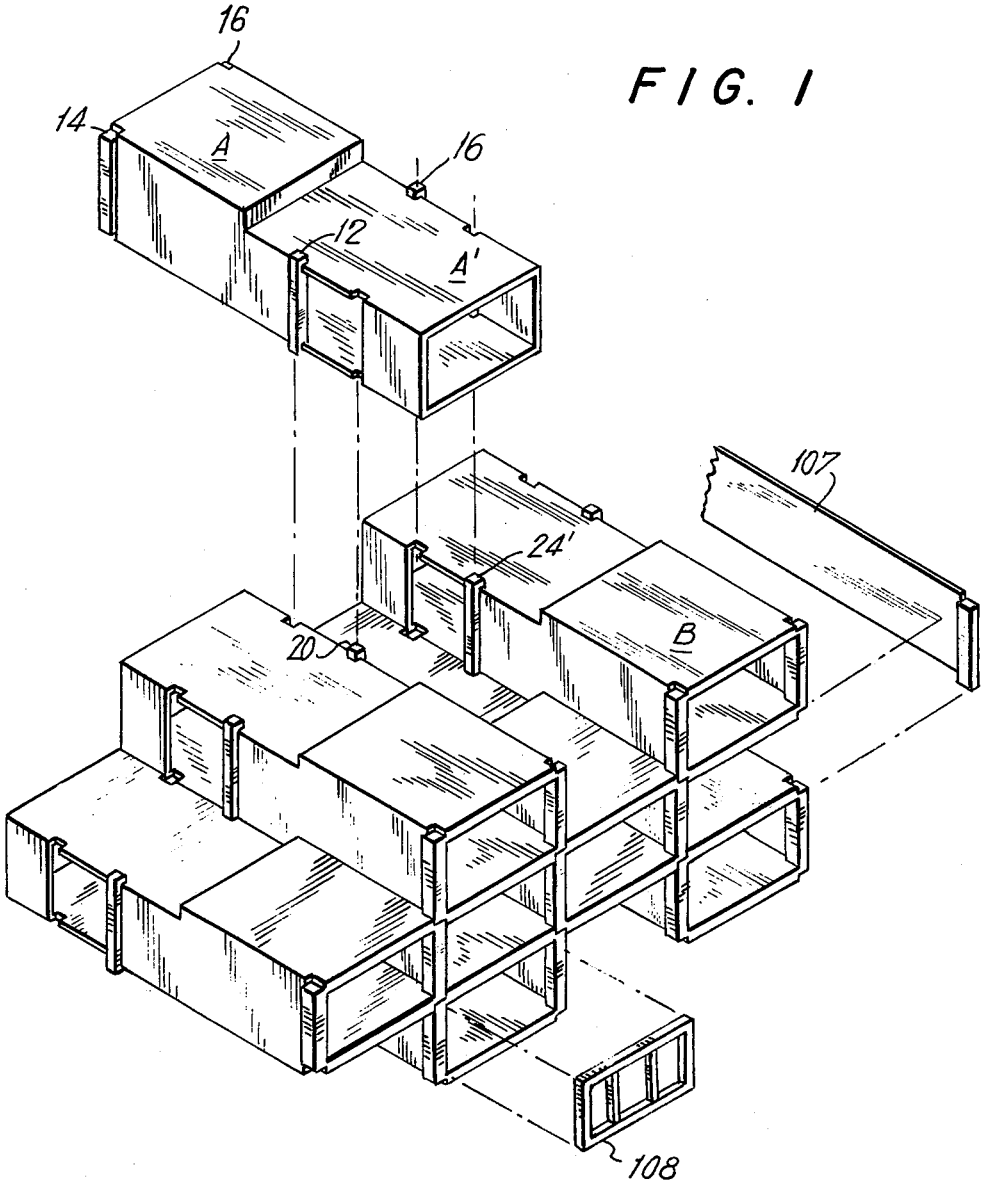
FIG. 1 is a perspective view of a building formed of stacked modular units of the type used in the present invention.
Figure 2:
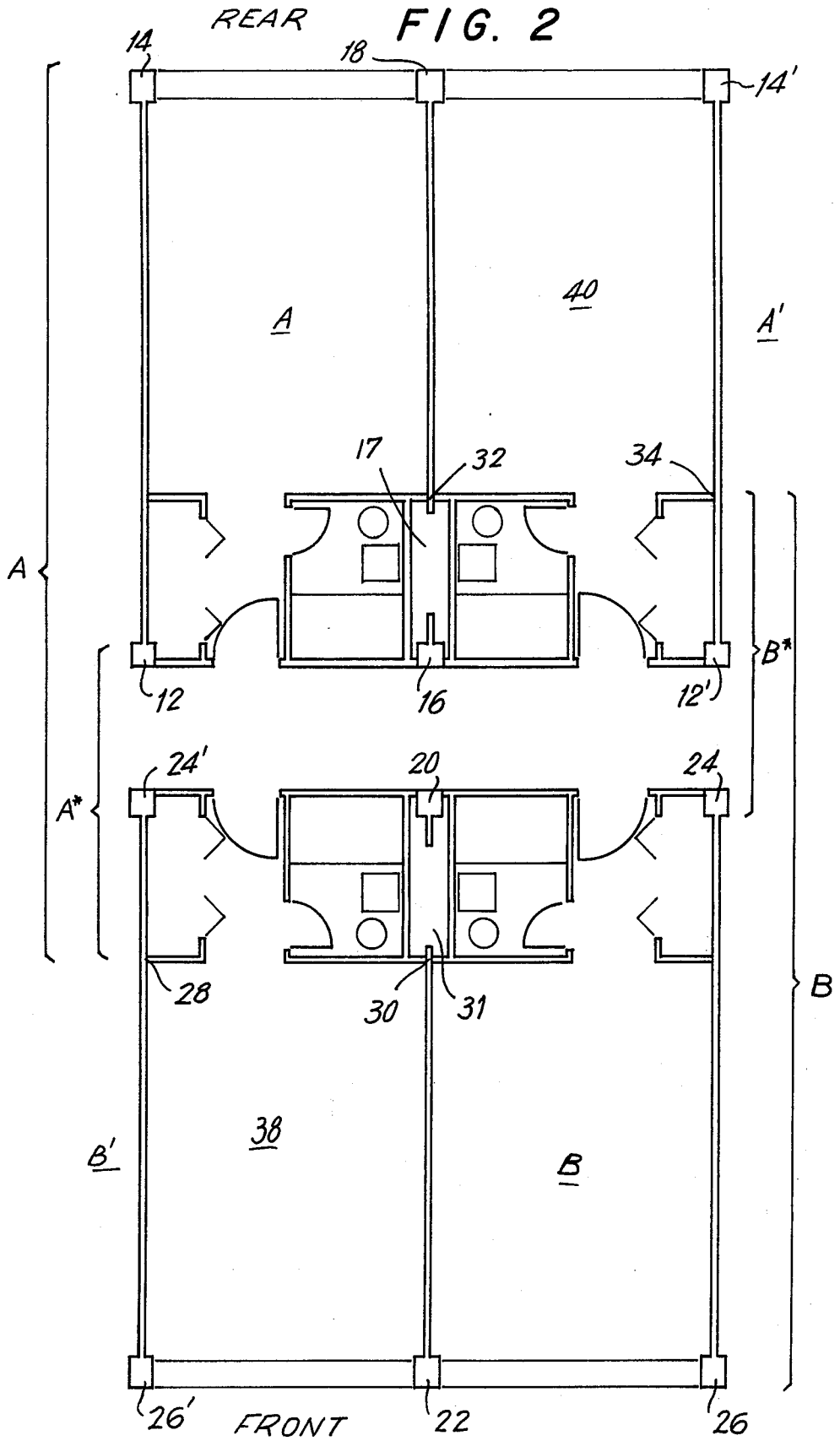
FIG. 2 is a plan view of a building showing the relation between adjacent units on the same floor, or row.

Referring now to the drawings, wherein like reference numerals are used throughout, FIG. 1 is a perspective view of a building formed of stacked modular units. As can be seen more clearly from FIG. 2, the units are arranged in respective rows, each row of units being stacked upon an immediately preceding, or underlying row, with each row being formed of a staggered configuration of units. For example, in a given row, units A and B are adjacent to each other and extend in opposite directions (FIG. 2). Merely for convenience, it will be assumed that unit A extends in a rearward direction and unit B extends in a frontward direction. Each unit is a box-like shape and includes a pair of exterior columns adjacent one of its ends and a pair of interior columns, intermediate its ends the pair of columns closest to the interior of the building being spaced from the pair of columns closest to the exterior of the building by a distance less than the overall length of the unit itself. Thus, and with respect to unit A, exterior columns 14 and 18 are formed as load-bearing columns and interior columns 12 and 16 are formed as load-bearing columns. However, it is seen that unit A extends from exterior columns 14, 18 to interior points 28, 30. Accordingly, that portion of unit A which extends between interior columns 12, 16 and interior points 28, 30 is cantilevered, and is identified by reference numeral A*. Similarly, unit B is formed of exterior columns 22, 26 and interior columns 20, 24. However, the overall length of unit B extends from exterior columns 22, 26 to interior points 32, 34. Accordingly, a cantilevered portion B* is provided in unit B between interior columns 20, 24 and rearward points 32, 34.

Each unit is preformed at a factory and is delivered to a building site where the units are stacked so as to construct a building. The units may be preformed in two stages wherein its side walls and roof slab are cast first and its floor slab then is poured so as to form a monolithic structure.

When the units are stacked so as to form the structure shown in FIG. 1, the support columns of an overlying unit, that is, a unit disposed in the next higher row, will be supported by respective columns of the units in the underlying row. More particularly, and as can be seen from FIG. 2, when the next row of units is placed upon the illustrated row, unit A in the higher row will not be placed precisely over unit A of the lower row. Rather, column 14 of unit A of the next higher row will be supported on column 18 of unit A of the next lower row, and column 12 of unit A of the next higher row will be supported on column 16 of unit A on the next lower row. Also, columns 16 and 18 of unit A of the next higher row will be supported on columns 12' and 14' of unit A' on the next lower row. Hence, unit A of the next higher row cooperates with units A and A' of the next lower row and with yet another unit A of still another lower row so as to define space 40. That is, the floor of space 40 corresponds to the ceiling of the unit in the lowest row, the side walls of space 40 correspond to the side walls of units A and A' in the intermediate row, and the ceiling of space 40 corresponds to the floor of unit A in the next higher row.

A similar arrangement is formed when a unit B in the next higher row is stacked so as to define space 38 therebeneath. That is, stacked unit B has its support columns 24, 26 supported by columns 20, 22, respectively, of unit B in the underlying row, and has its columns 20, 22 supported by colums 24', 26', respectively of unit B'.

In an alternative embodiment, the side walls of a unit of the next higher row, such as unit A of the next higher row, are supported by one side wall each of alternate units A and A' of the next lower row. In yet another alternative, the floor of the unit of the next higher row is supported either by the side walls of each of two alternate units or the ceiling of each of two alternate units (such as A and A') of the next lower row.

Each unit may be preformed to have interior appointments as desired. Hence, if these units are to be constructed so as to form a residential building, each unit may comprise a complete apartment or selected rooms of that apartment, such as kitchen, bathroom and the like. As may be seen from FIG. 2, the spacing between the interior side walls in a portion of unit A is less than the overall width of this unit. Similarly, the interior walls of unit B are spaced from each other by a distance less than the overall width of this unit. Hence, when units A and B are arranged adjacent each other, as shown in FIG. 2, spaces 17 and 31 are formed between the adjacent walls of such units, thereby providing air shafts or other ducts or conduits between units. As may be appreciated, such spaces are created between the cantilevered portion of one unit and the main portion of the adjacent unit.

When the units are arranged in stacked rows, the cantilevered portion of an overlying unit which extends in one direction is supported, in part, by the underlying unit which extends in the opposite direction. As one example, when unit A is stacked to overlie space 40 and to have its columns 12, 14 supported by columns 16, 18, respectively, and its columns 16, 18, supported by columns 12', 14', respectively, cantilevered portion A* is supported, in part, by columns 20, 24 of underlying unit B. Alternatively, cantilevered portion A* is supported, at least in part, by the side walls and/or by the ceiling of underlying unit B.

When constructed as shown in FIG. 1, front (and rear) panels 108 are secured to the exposed portions of selected ones of the stacked units. Typically, these panels are formed of exterior siding and window units. In addition, side panels 107 are secured to the side of the completed structure so as to provide exterior walls and/or window units, for example, so as to enclose spaces 38 and 40 (FIG. 2). Alternatively, these panels may be formed monolithically with the units.

Figure 3:
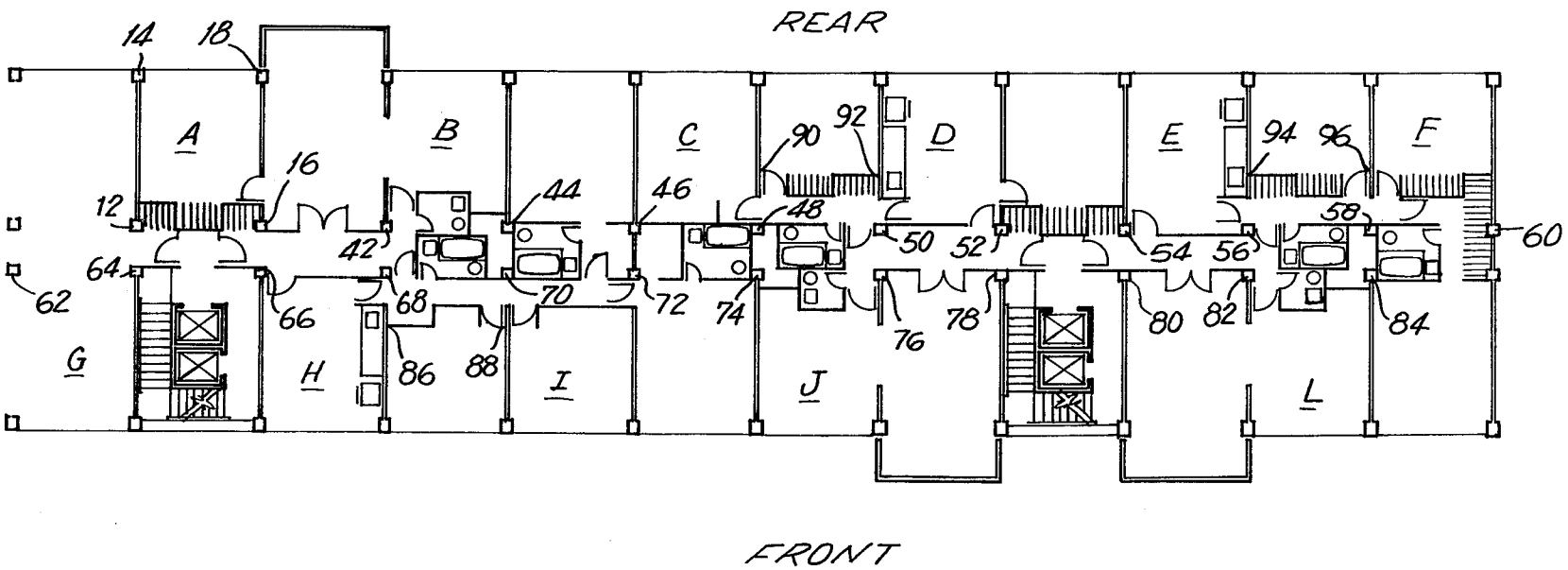
FIG. 3 is another plan view of a building showing a row of units arranged to form a floor of that building.

In the plan view of a typical floor-plan arrangement of one row of staggered units, as shown in FIG. 3, the building is provided with units A, B, C . . . extending in the rearward direction, and units G, H, I . . . extending in the frontward direction, these units being arranged relative to each other in a manner similar to that shown in FIG. 2. As shown in FIG. 3, interior columns 12, 16 of unit A, interior columns 42, 44 of unit B and rearward columns 46, 48 of unit C are spaced from interior columns 66, 68 of unit H, interior columns 70, 72 of unit I and interior columns 74, 76 of unit J, all disposed in staggered configuration. When the next row of staggered units is placed over the illustrated row, the cantilevered portions of the rearwardly extending units of the next higher row are supported in part by the frontwardly extending units of the lower row, such as by the interior columns of these lower, frontwardly extending units. Also, the cantilevered portions of the frontwardly extending units of the next higher row are supported in part by the rearwardly extending units of the lower row, such as by the interior columns of these lower, rearwardly extending units. In the embodiment shown in FIG. 3, the cantilevered portion of a unit extends no farther than the interior columns of the adjacent, staggered units. This differs from the embodiment shown in FIG. 2 wherein the cantilevered portion of a unit extends further back from the interior columns of the adjacent, staggered units. However, if desired, some of the units shown in FIG. 3 may have a greater overall length than other units. For example, the overall length of unit B extends beyond columns 68 and 70 of adjacent, staggered units H and I, respectively, to points 86 and 88. Similarly, the overall length of unit J extends beyond columns 48 and 50 of adjacent, staggered units C and D to points 90 and 92. Still further, the overall length of unit L extends beyond columns 56 and 58 of units E and F, respectively, to points 94 and 96. Thus, a part of the cantilevered portion of units B, J and L, respectively, remains cantilevered even after the illustrated row is stacked upon an underlying row. This is illustrative of the feature wherein each unit may have a greater overall length than heretofore proposed, because of the cantilevered portion of such a unit. Nevertheless, even with this greater length, additional support columns need not be provided for such longer units.

Figure 4:
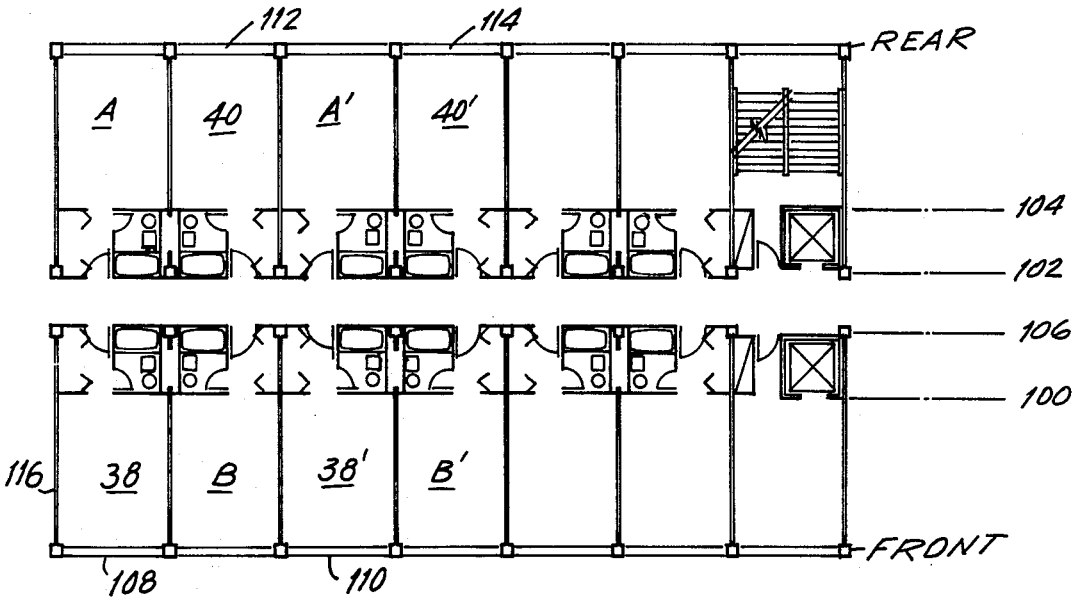
FIG. 4 is yet another plan view of a building similar to the plan view shown in FIG. 3, and illustrating the formation of vertical shafts in the building.

FIG. 4 shows a floor plan formed of units similar to those described previously with respect to FIG. 2. Accordingly, rearwardly extending units A, A', . . . are staggered with frontwardly extending units B, B' . . . with spaces 38, 38', 40 and 40' created between such staggered units, as shown. In particular, units A, A' extend from the rear of the building to dimension line 100 and exhibit a cantilevered portion extending between dimension line 102 and dimension line 100. Similarly, units B, B' extend from the front of the building to dimension line 104 and exhibit a cantilevered portion extending between dimension lines 106 and 104. When the building is constructed of stacked rows, the cantilevered portions of overlying units A, A' (not shown) will be supported at least in part by the columns of underlying units B, B' aligned with dimension line 106; and the cantilevered portions of overlying units B, B' (not shown) will be supported at least in part by the columns of underlying units A, A' aligned with dimension line 102. Hence, in construction, the cantilevered portion of, for example, unit A will remain between dimension lines 106 and 100; and the cantilevered portion of, for example, unit B, will remain between dimension lines 102 and 104.

For completing the construction of the building formed of stacked rows of the type shown in FIG. 4, front walls 108, 110, 112 and 114 are secured so as to enclose spaces 38, 38', 40 and 40', respectively. Also, side walls 116 are provided to further enclose those spaces, such as space 38, which are formed at the respective sides of the building.

Figure 5:
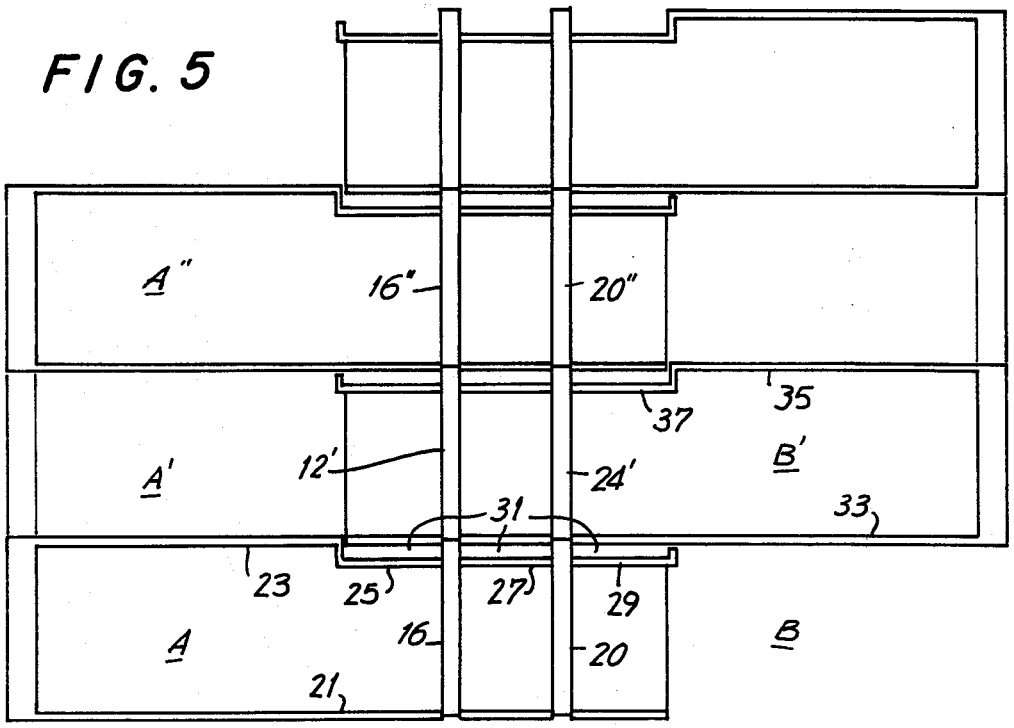
FIG. 5 is a vertical cross-sectional view of a portion of the building formed of modular units having cantilevered portion, and illustrating the formation of horizontal ducts and other conduits as a result of the stacking of such units.

FIG. 5 is a vertical cross-sectional view of a stacked configuration of staggered rows of the type discussed above. Stacked units A, A' . . . extend in one direction while stacked units B, B' . . . extend in the opposite direction. It is appreciated that the units A and B, A' and B', . . . are arranged in respective staggered rows. Accordingly, interior column 16 on unit A is aligned with interior column 12' on stacked unit A' which, in turn, is aligned with interior column 16'' on unit A''. Similarly, interior column 20 on unit B is aligned with interior colunn 24' on stacked unit B' which, in turn, is aligned with interior column 20'' on unit B''. Unit A is provided with a floor 21 and a ceiling 23. This ceiling is lowered at 25 and thhe cantilevered portion of this ceiling which extends beyond column 16 is shown at 27 and 29. Overlying unit B' is provided with a floor 33 which extends above and overlies lowered ceiling portions 25, 27 and 29 of unit A. Hence, spaces 31 are formed between floor 33 of unit B' and the depressed ceiling portion of unit A. A similar arrangement is formed when unit A'' is stacked above unit B'.

Figure 7:
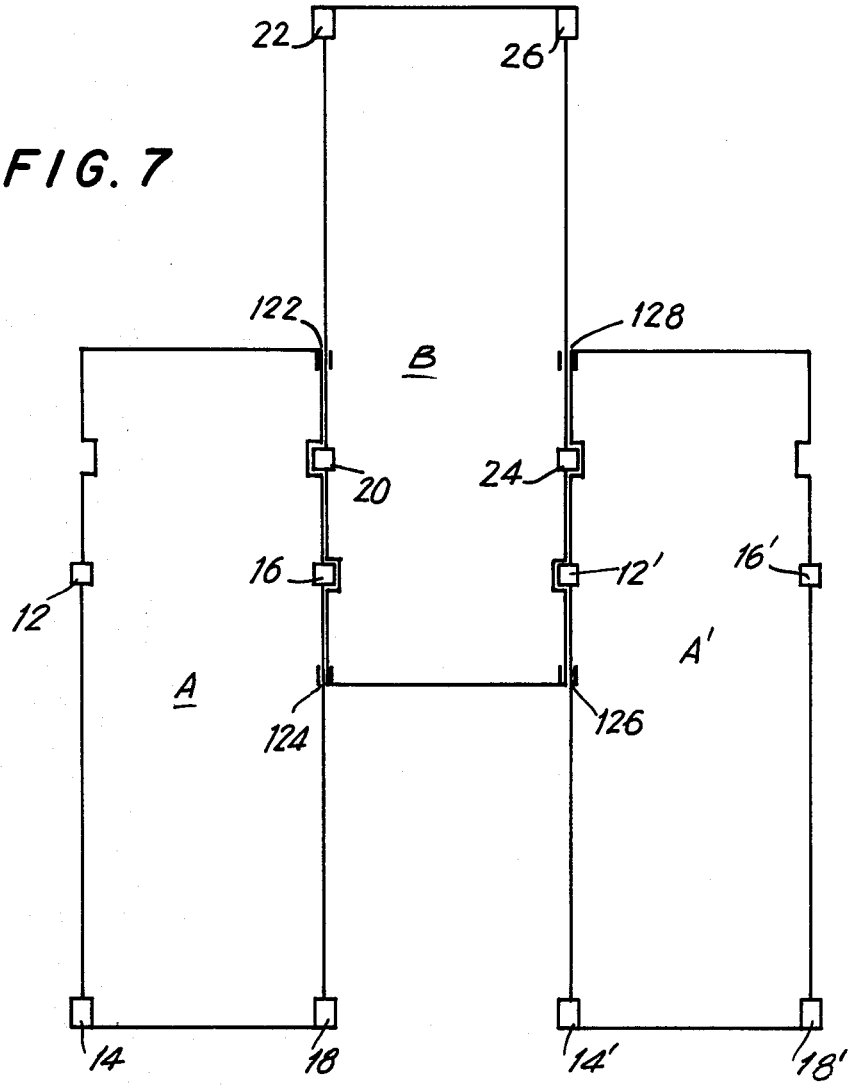
FIG. 7 is a diagrammatic view showing the interrelationship between the cantilevered portions of adjacent units.

The cantilevered portion of unit B' is supported, in part, by column 16 of underlying unit A. Similarly, the cantilevered portion of unit A' is supported, in part, by column 20 of underlying unit B. In one embodiment, the side wall, floor and roof of unit A are cut out, or notched, in the vicinity of column 20 so as to provide sufficient clearance for column 20, as shown in FIG. 7. Similarly, the side wall, floor and roof of unit B is cut out, or notched, to provide sufficient clearance for column 16 of unit A. In another embodiment, column 20 of unit B is notched so as to receive a laterally extending portion, or flange, of ceiling portion 27, 29 of the cantilevered segment of unit A.

When spaces 31 are formed between overlying units A and B', such spaces can be used as air conditioning ducts, or to provide locations for electrical and/or plumbing conduits, and the like. In addition, various mechanical structures which may be needed for maintenance or utility purposes can be provided in such spaces.

Figure 6:
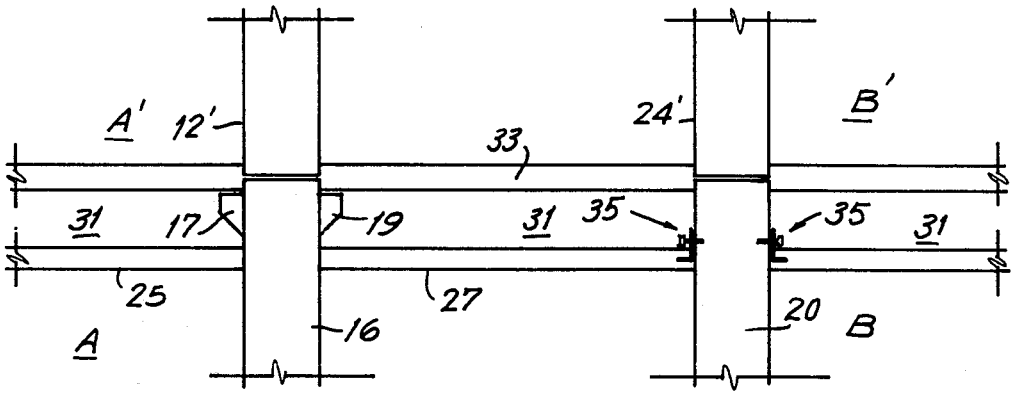
FIG. 6 is a sectional view showing the manner in which four units are supported on respective support columns.

A more detailed view of the manner in which the respective columns support the units is shown in FIG. 6. Column 16 is provided with support brackets 17 and 19 for supporting the floor 33 of the cantilevered portion of unit B'. Since ceiling 25, 27 of unit A is lowered, or depressed, relative to ceiling 23, column 16 extends above the lowered ceiling portion of unit A. Column 20 of unit B is adapted to receive a bracket, shown generally at 35, secured to ceiling portion 27 of unit a and bolted to column 20. Hence, column 20 provides some support for the ceiling of the cantilevered portion of unit A. As an alternative, brackets 35 can be replaced by welding a metal portion of ceiling 27 to a corresponding metal portion of column 20. Similarly, floor 33 of unit B' can be welded to column 16 of unit A or column 12' of unit A', thereby obviating support brackets 17 and 19. As a further alternative, brackets similar to brackets 35 can be provided between floor 33 and column 12'.

In yet another modification, as schematically shown in FIG. 7, a part of the cantilevered portion of one unit is connected at least to one adjacent unit. This provides additional support for the cantilevered portion. For example, a connecting member 122 is provided between the cantilevered portion of unit A and the main portion of unit B. Similarly, connecting members 124 and 126 are provided between the cantilevered portion of unit B and the main portion of units A and A', respectively; and a connecting member 128 is provided between the cantilevered portion of unit A' and the main portion of unit B. These connecting members may be brackets, welded plates, interlocks, bolts or other typical connectors. Also, the connections may extend from wall to wall, floor to floor, ceiling to ceiling or combinations of these.

Still further, the adjacent unit may lie in the same row or in overlying rows, wherein connections for the latter configuration may extend between floor and ceiling.

While the present invention has been shown and described with reference to certain preferred embodiments, it should be readily understood that various changes and modifications in form and detail can be made without departing from the spirit and scope of the invention. For example, and as shown in FIG. 1, suitable doorways or passageways may be formed in the side walls of the cantilevered portions of the respective units so as to provide a common corridor through the completed structure. Still further, the support columns of each unit may be formed integrally with the side walls, or may be formed externally or internally of such walls. As also shown in FIG. 1, the interior columns may be external of the side walls of the cantilevered portion of a respective unit, and such interior columns may be provided with suitable notches, if desired, to support the ceiling of the cantilevered portion of that unit. It is intended that the appended claims be interpreted as including the foregoing as well as all other such changes and modifications.

What is claimed is:

1. A modular construction system for a plural-level building, comprising a plurality of box-like modular units, each having side walls, a roof member including a ceiling, and a floor to form a monolithic module; each said modular unit having a cantilevered portion; said units being stacked to form a building structure wherein said units are arranged in a first row in staggered configuration with alternate units in said first row extending in a frontward direction and remaining units in said first row extending in a rearward direction, the cantilevered portions of said frontward extending units overlapping with the cantilevered portions of said rearward extending units; and wherein said units are arranged in a second row overlying said first row, said units in said second row being in staggered configuration such that alternate units in said second row extend in a frontward direction and remaining units in said second row extend in a rearward direction, one of said units in said second row being supported by a pair of units in said first row, and at least a part of said cantilevered portion of said one unit in said second row being supported at least in part by an adjacent modular unit.

2. The modular construction system of claim 1 wherein alternate units in said first row cooperate with alternate units in said second row thereby to define a space therebetween.

3. The modular construction system of claim 1 wherein the ceiling in the cantilevered portion of a unit is lowered relative to the ceiling in the remaining portion of said unit by a distance substantially in excess of the thickness of the unit's roof member.

4. The modular construction system of claim 3 wherein the lowered ceiling of a unit in the first row cooperates with the floor of an overlying unit in the second row to define a space therebetween.

5. A modular construction system for a plural-level building, comprising a plurality of box-like modular units, each having side walls, a roof member and a floor to form a monolithic module; a plurality of support columns formed with each said modular unit, said columns including a first pair of columns intermediate the ends of each unit and a second pair of columns adjacent one of the ends of each unit, each said modular unit having a centilevered portion extending beyond its said first pair of columns; said units being stacked to form a building structure wherein said units are arranged in a first row in staggered configuration with alternate units in said first row extending in a frontward direction and remaining units in said first row extending in a rearward direction, the cantilevered portions of said frontward extending units overlapping with the cantilevered portions of said rearward extending units; and wherein said units arranged in a second row overlapping said first row, said units in said second row being in staggered configuration such that alternate units in said second row extend in a frontward direction and remaining units in said second row extend in a rearward direction, the first pair of columns of one of said units in said second row being supported by respective columns of a pair of units in said first row, and at least a portion of said cantilevered portion of said one unit in said second row being supported by the first pair of columns of the underlying unit in said first row.

6. A modular construction system for a plural-level building, comprising a plurality of box-like modular units, each having side walls, a roof member and a floor to form a monolothic model; a plurality of not more than four support columns formed with each said modular unit, said columns including a first pair of columns intermediate the ends of each unit and a second pair of columns adjacent one of the ends of each unit, each said modular unit having a cantilevered portion extending beyond its said first pair of columns; said units being stacked to form a building structure wherein said units are arranged in a first row in staggered configuration with alternate units in said first row extending in a frontward direction and remaining units in said first row extending in a rearward direction, the cantilevered portions of said frontward extending units overlapping with the cantilevered portions of said rearward extending units; and wherein said units are arranged in a second row overlying said first row, said units in said second row being in staggered configuration such that alternate units in said second row extend in a frontward direction and remaining units in said second row extend in a rearward direction, the first pair of columns of one of said units in said second row being supported by one of the first pair of columns of each of two alternate units in said first row extending in a like direction, and at least a portion of said cantilevered portion of said one unit in said second row being supported by the first pair of columns of the underlying unit in said first row, which underlying unit extends in an opposite direction, said first pair of columns of said underlying unit in said first row being provided with support members for supporting the floor of the cantilevered portion of said one unit in said second row.

7. A modular construction system for a plural-level building, comprising a plurality of box-like modular units, each having side walls, a roof member and a floor to form a monolithic module; a plurality of support columns formed with each said modular unit, said columns including a first pair of columns intermediate the ends of each unit and a second pair of columns adjacent one of the ends of each unit, each said modular unit having a cantilevered portion extending beyond its said first pair of columns; said units being stacked to form a building structure wherein said units are arranged in a first row in staggered configuration with alternate units in said first row extending in a frontward direction and remaining units in said first row extending in a rearward direction, the cantilevered portions of said frontward extending units; overlapping with the cantilevered portions of said rearward extending units; and wherein said units are arranged in a second row overlying said first row, said units in said second row being in staggered configuration such that alternate units in said second row extend in a frontward direction and remaining units in said second row extend in a rearward direction, the first pair of columns of one of said units in said second row being supported by one of the first pair of columns of each of two alternate units in said first row extending in a like direction, and at least a portion of said cantilevered portion of said one unit in said second row being supported by the first pair of columns of the underlying unit in said first row, which underlying unit extends in an opposite direction, and means secured to the exterior of a selected column in the first pair of columns of a unit in said first row for supporting the roof member of the cantilevered portion of an adjacent, staggered unit in the same row.

8. The modular construction system of claim 7 wherein said last-mentioned means comprises a bracket bolted between said selected column and said roof member.

9. The modular construction system of claim 7 wherein said selected last-mentioned means comprises a notched portion in said column for receiving a portion of ,said roof member.

10. The modular construction system of claim 7 wherein said last-mentioned means comprises a bracket welded between said selected column and said roof member.

11. The modular construction system of claim 7 wherein said last-mentioned means comprises an interlock between said selected column and said roof member.

12. A modular construction system for a plural-level building, comprising a plurality of box-like modular units, each having side walls, a roof member and a floor to form a monolithic module; each said modular unit having a cantilevered portion; said units being stacked to form a building structure wherein said units are arranged in a first row in staggered configuration with alternate units in said first row extending in a frontward direction and remaining units in said first row extending in a rearward direction, the cantilevered portions of said frontward extending units; overlapping with the cantilevered portions of said rearward extending units and wherein said units are arranged in a second row overlying said first row, said units in said second row being in staggered configuration such that alternate units in said second row extend in a frontward direction and remaining units in said second row extend in a rearward direction, one of said units in said second row being supported by a pair of units in said first row, and at least a part of said cantilevered portion of said one unit in said second row being supported at least in part by an adjacent modular unit; one of the side walls of the cantilevered portion of a given unit being spaced from one of the side walls of the next adjacent, staggered unit in the same row so as to define a space therebetween.

13. The modular construction system of claim 12 wherein the side walls in the cantilevered portion of said given unit being spaced apart less than the external width of said given unit.

14. A modular construction system for a plural-level building, comprising a plurality of box-like modular units, each having side walls, a roof member including a ceiling, and a floor to form a monolithic module; each said modular unit having a cantilevered portion; said units being stacked to form a building structure wherein said units are arranged in a first row in staggered configuration with alternate units in said first row extending in a frontward direction and remaining units in said first row extending in a rearward direction, the cantilevered portions of said frontward extending units overlapping with the cantilevered portions of said rearward extending units; and wherein said units are arranged in a second row overlying said first row, said units in said second row being in staggered configuration such that alternate units in said second row extend in a frontward direction and remaining units in said second row extend in a rearward direction, one of said units in said second row being supported by a pair of units in said first row, and at least a part of said cantilevered portion of said one unit in said second row being supported at least in part by an adjacent modular unit; the ceiling in the cantilevered portion of a given unit in said first row being lowered relative to the ceiling in the remaining portion of said given unit by a distance substantially in excess of the thickness of the unit's roof member, said lowered ceiling of said given unit in said first row cooperating with the floor of an overlying unit in said second row to define a mechanical duct while the remaining portion of said ceiling being in contact with the floor of the overlying unit.

15. A modular construction system for a plural-level building, comprising a plurality of box-like modular units, each having side walls, a roof member and a floor to form a monolithic module; each said modular unit having a cantilevered portion; said units being stacked to form a building structure wherein said units are arranged in a first row in staggered configuration with alternate units in said first row extending in a frontward direction and remaining units in said first row extending in a rearward direction, the cantilevered portions of said frontward extending units overlapping with the cantilevered portions of said rearward extending; and wherein said units are arranged in a second row overlying said first row, said units in said second row being in staggered configuration such that alternate units in said second row extend in a frontward direction and remaining units in said second row extending in a rearward direction, one of said units in said second row being supported by a pair of units in said first row, and at least one wall of said cantilevered portion of a unit in one row being connected to one of the walls of an adjacent modular unit in the same row.

16. A modular construction system for a plural-level building, comprising a plurality of box-like modular units, each having side walls, a roof member including a ceiling, and a floor to form a monolithic module; each said modular unit having a cantilevered portion; said units being stacked to form a building structure wherein said units are arranged in a first row in staggered configuration with alternate units in said first row extending in a frontward direction and remaining units in said first row extending in a rearward direction, the cantilevered portions of said frontward extending units overlapping with the cantilevered portions of said rearward extending units; and wherein said units are arranged in a second row overlying said first row, said units in said second row being in staggered configuration such that alternate units in said second row extend in a frontward direction and remaining units in said second row extend in a rearward direction, one of said units in said second row being supported by a pair of units in said first row and at least the ceiling of said cantilevered portion of a unit in one row being connected to the ceiling of an adjacent modular unit in the same row.

17. A modular construction system for a plural-level building, comprising a plurality of box-like modular units, each having side walls, a roof member and a floor to form a monolithic module; each said modular unit having a cantilevered portion; said units being stacked to form a building structure wherein said units are arranged in a first row in staggered configuration with alternate units in said first row extending in a frontward direction and remaining units in said first row extending in a rearward direction, the cantilevered portions of said frontward extending units overlapping with the cantilevered portions of said rearward extending units; and wherein said units are arranged in a second row overlying said first row, said units in said second row being in staggered configuration such that laternate units in said second row extend in a frontward direction and remaining units in said second row extend in a rearward direction, one of said units in said second row being supported by a pair of units in said first row, and at least the floor of said cantilevered portion of a unit in one row being connected to the floor of an adjacent modular unit in the same row.

18. A modular construction system for a plural-level building, comprising a plurality of box-like modular units, each having side walls, a roof member including a ceiling, and a floor to form a monolithic module; each said modular unit having a main portion and a cantilevered portion; said units being stacked to form a building structure wherein said units are arranged in a first row in staggered configuration with alternate units in said first row extending in a frontward direction and remaining units in said first row extending in a rearward direction, the cantilevered portions of said frontward extending units overlapping interiorly of said building structure with the cantilevered portions of said rearwardly extending units; and wherein said units are arranged in a second row overlying said first row, said units in said second row being in staggered configuration such that alternate units in said second row extend in a frontward direction and remaining units in said second row extend in a rearward direction, one of said units in said second row being supported by a pair of units in said first row, and at least a part of said cantilevered portion of said one unit in said second row being supported at least in part by an adjacent modular unit, the ceiling in the cantilevered portion and in a part of the main portion of a given unit being lowered relative to the remainder of said ceiling in said main portion by a distance substantially in excess of the thickness of the unit's roof member while the remaining portion of said ceiling being in contact with the floor of the overlying unit.

* * * * *